US006092807A

United States Patent [19]

Yu

[11] Patent Number: 6,092,807

[45] Date of Patent: Jul. 25, 2000

[54] COIN OPERATED AMUSEMENT DEVICE

[76] Inventor: Hong Yu, 41 Baldwin La., Hollis, N.H. 03049

[21] Appl. No.: 09/204,231

[22] Filed: Dec. 3, 1998

[51] Int. Cl.[7] ..... A63B 71/00; A63F 1/18

[52] U.S. Cl. ..... 273/144 R; 273/138.1; 273/138.2; 273/138.3

[58] Field of Search ..... 273/138.1, 138.2, 273/138.3, 144 R

[56] References Cited

U.S. PATENT DOCUMENTS

| | | | |
|---|---|---|---|
| 4,061,334 | 12/1977 | Kanno | 273/129 Q |
| 4,871,055 | 10/1989 | Poythress et al. | 446/8 |
| 5,176,380 | 1/1993 | Evans et al. | 273/138 A |
| 5,297,816 | 3/1994 | Becchio | 273/138.3 |
| 5,622,366 | 4/1997 | Inoue | 273/138.2 |

*Primary Examiner*—Jeanette Chapman
*Assistant Examiner*—Dolores R. Collins
*Attorney, Agent, or Firm*—Stephen G. Matzuk

[57] ABSTRACT

The apparatus according to the present invention provides an arcade machine receiving a coin from each player along one or more coin paths which determine the coin path and thus the outcome of the player's participation. The coins are introduced tangentially from one of several locations to the outer edge of a funnel-like bowl with a lowered center exit, and proceed generally around the bowl and exits to a generally planar table below the exit, which includes revolving blades to stir the coins in the table. As the coins accumulate or are urged by the blades, and eventually fall from the outer perimeter of the table to coin output drawers or openings, where the coins may be withdrawn by the player as winnings.

7 Claims, 2 Drawing Sheets

COIN OPERATED AMUSEMENT DEVICE

FIELD OF THE INVENTION

The present invention relates amusement devices, in particular to multi-player coin operated amusement devices having a moving coin dispersement device therein.

BACKGROUND OF THE INVENTION

Amusement devices have tended to become increasingly complex and sophisticated, the added technology often being counterproductive to the enjoyment of the players. Also, the increased complexity increases the costs of initial purchase and maintenance. Moreover, unless care is taken in the amusement device to integrate random chance outcome with some fine motor skills of the player, and further with easily understandable and viewable operation, the amusement value of the device to the player quickly diminishes.

SUMMARY OF THE INVENTION

The apparatus according to the present invention provides an arcade machine offering greater attraction and entertainment by receiving a coin from each player along one or more coin paths which determine the coin path and thus the outcome of the player's participation. The coins are introduced tangentially from one of several locations to the outer edge of a funnel-like bowl with a lowered center exit. The coins proceed generally around the bowl and exits to a generally planar table below the exit. The planar table includes a revolving blade to stir the coins in the table.

As the coins accumulate or are urged by the blade, and eventually fall from the outer perimeter of the table to coin output drawers or openings, where the coins may be withdrawn by the player.

Moreover, the apparatus according to the present invention permits multiple and/or competitive player participation wherein the individual player's coins may be selectively introduced to either proceed independently or mutually interfere according to the relative point and velocity, etc. the coins are introduced. Moreover, the apparatus includes multiple coin drawers or exit openings positioned on the side of the apparatus facing a particular player, multiple winners are possible for each interaction.

The present invention also allows viewing of substantially the entire surface and workings of the apparatus, and provides for the enhanced attraction to the player by viewing and illuminating the moving elements and the coin as it proceeds through the apparatus. Thus, the apparatus according to the present invention provides a coin operated arcade amusement device having a minimum of movable parts, yet offering maximized entertainment with minimal moving component parts.

BRIEF DESCRIPTION OF THE DRAWING

These and further features of the present invention will be better understood by reading the following Detailed Description together with the Drawing, wherein.

DETAILED DESCRIPTION OF THE INVENTION

Figure 1:
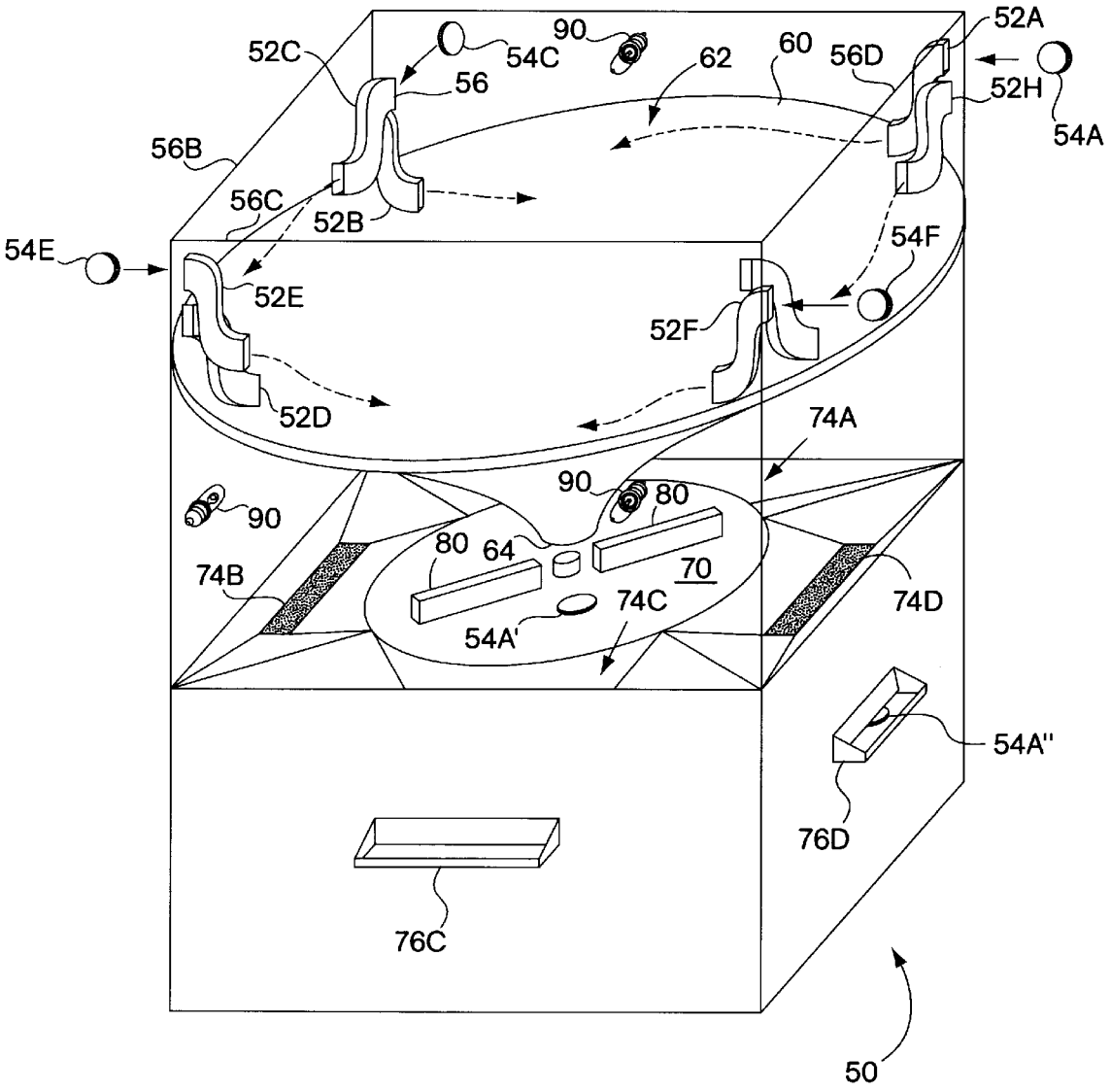
FIG. 1 is a perspective view of one embodiment according to the present invention.

According to the embodiment FIG. 1, the arcade device 50 permits one or more players at respective coin slots at stations around the device 50, generally associated with a particular side of the surrounding transparent enclosure. The coin e.g. 54A, 54C, 54E, 54F, will be received through a coin slot accessible via openings on the device sides 56A–56D, on the end of coin guides 52A–52H which orients the plane of the inserted coin to a generally vertical orientation, typically orthogonal to the surface of a large opening 62 of a funnel shaped bowl 60 to which the coin is introduced. The funnel shaped bowl 60 includes a lower exit 64 opening and an intervening surface which allows the coin 54A' to circle about the exit opening and eventually pass therethrough. In the preferred embodiment, the exit 64 is located at the center of the bowl 60.

The coins e.g. 54A, which emerge through the exit are received on a coin tray planar surface 70 typically having a number of collection segments e.g. 74A, 74B, 74C and 74D, distributed about the outer perimeter of the planar surface. A moving stirrer 80 is provided to disperse the coins over the planar surface and ultimately over and out one or more of the segments. In the preferred embodiment, the coins are distributed in a manner wherein the coins fall off the edge of the segments without preference, that is, uniformly at random and by chance.

Figure 2:
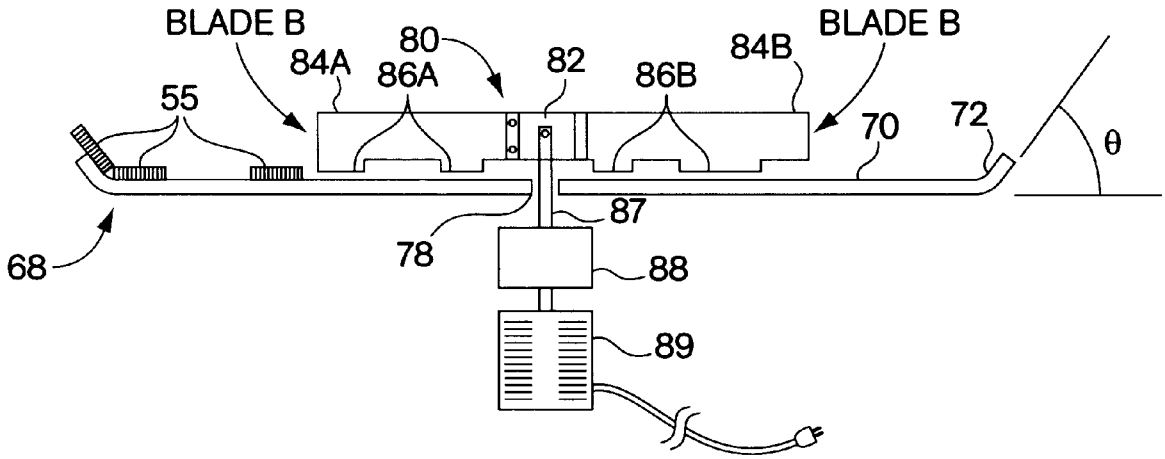
FIG. 2 is a side elevation and partial cross-sectional view of the planar surface and stirrer device according to the embodiment of FIG. 1.

A further feature of the preferred embodiment as shown in FIG. 2, provides an lip 72 elevated at an angle θ at the perimeter of the planar surface 70 to impose an increase in friction presented to the coins as they proceed over the edge of the planar surface and thus to increase the number of coins retained thereon. moreover, the lip 72 may permit an accumulation of several coins to fall, thus rewarding the player with a greater payoff. As the coins fall from the planar surface, they fall into the nearest segments and into player accessible open drawers e.g. 76C, 76D or other player accessible openings associated with each planar surface segments.

In the preferred embodiment, the moving stirrer 80 comprises a double-ended paddle having two arms 84A and 84B symmetrically disposed about a motor 89 shaft 87 extending through an opening 78 in the planar surface. The two arms 84A and 84B have portions 86A and 86B thereof disposed toward the planar surface 70 to contact and movably urge the coins 55 received from said bowl at selectively radial spacings. The portions 86A and 86B of each of said arms are preferably different from the other arms to provide a more varied stirring effect.

The attraction of the player to the apparatus according to the present invention may be enhanced with the inclusion of lights 90, intermittent, synchronized with the movement of the coin(s) or stirrer, or constant, about the interior of the transparent enclosure 56, which may be made entirely or in part transparent, opaque and/or mirrored.

Figure 3:
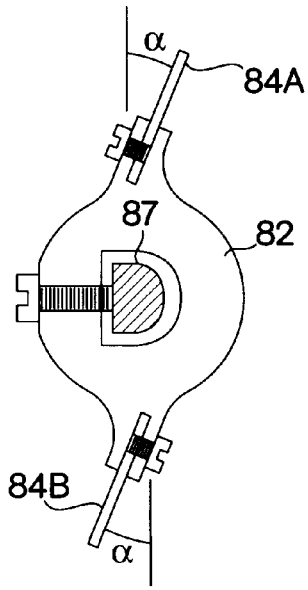
FIG. 3 is a plan view of the stirrer blade and shaft coupler according to the embodiment of FIG. 1.

The stirrer typically revolve at a moderate rate of 1-60 revolutions per minute as provided by the motor 89 and gear reduction assembly 88. Moreover, the arms 84A and 84B of the moving stirrer 80 may be non-collinear, that is be disposed about planes parallel, and offset by an angle a from a common plane, as shown in the hub 82 of FIG. 3.

The amusement device according to the present invention provides a novel single or multi-user entertainment device having a large attraction and a minimum of moving parts. The amusement device may be operated according to a developed skill or as a challenge or competition among several players, wherein any or all may win coins which fall into the coin drawer or output openings, e.g. 76C and 76D.

These and further modifications made according to the teaching above are within the scope of the present invention, which is not to be limited except by the following claims.

What is claimed is:

1. An amusement apparatus comprising, a funnel-shaped bowl having a large upward facing opening and a smaller, downward facing exit, being transitionally tapered therebetween;

a coin introducer adapted to receive a player's coin and introduce the coin substantially tangentially to the large opening of the bowl, wherein said introduced coin travels about said exit and eventually exits said bowl through said exit;

a planar surface disposed beneath said bowl exit for axially receiving said coins after they exit said bowl;

a coin receiver having a segment collector disposed beyond the edge of said planar surface; and a moving stirrer disposed in relation to said planar surface to move at least some of said coins received thereon from said bowl further having an outer perimeter over which at least some of said received coins may be urged by said moving stirrer, wherein said coin receiver accumulates, all coins urged over said outer perimeter as a desired player payoff.

2. The amusement apparatus of claim 1, wherein said coin introducer comprises a ramp adapted to receives said coin and move said coin along a selected path and emerging therefrom with a vertical orientation of the plane of the coin and a lateral motion of said coin.

3. The amusement apparatus of claim 2, further comprising a case having a plurality of vertically disposed sides joined together and enclosing said bowl, wherein a plurality of said sides includes a coin introducer.

4. The amusement device of claim 1, further comprising a case having a plurality of vertically disposed sides, wherein at least one of said sides is substantially transparent, allowing said player to observe the progress of the coin through said amusement device.

5. The amusement device of claim 1, wherein said moving stirrer comprises an arm movable on a rotating shaft disposed substantially perpendicular from said planar surface.

6. The amusement device of claim 5, comprises a plurality of arms movable on said shaft and each having an irregular edge extending toward said movable surface, wherein said irregular edge of each said arm is shaped to contact coins received on said planar surface at different distances from said shaft.

7. The amusement device of said 5, wherein said planar surface peripheral edge has a plurality of segments disposed thereabout, and said rotating shaft is disposed relative said planar surface to substantially uniformly urges said received coins over the peripheral edge segments thereof.

* * * * *